US006783334B2

(12) United States Patent
Sanderson et al.

(10) Patent No.: US 6,783,334 B2
(45) Date of Patent: Aug. 31, 2004

(54) HYDRAULIC PUMP RESERVOIR HAVING DEAERATION DIFFUSER

(75) Inventors: Rodney M. Sanderson, Midland, MI (US); James L. Davison, Freeland, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/159,053

(22) Filed: May 31, 2002

(65) Prior Publication Data

US 2003/0223889 A1 Dec. 4, 2003

(51) Int. Cl.[7] ..... F04B 23/00; F04B 39/00; F04B 53/00

(52) U.S. Cl. ..... 417/313; 417/198; 60/453

(58) Field of Search ..... 60/453, 468, 494, 60/420; 417/313, 53, 77, 79, 87, 88, 91, 198

(56) References Cited

U.S. PATENT DOCUMENTS 4,127,143 A * 11/1978 Zinga ..... 137/592
4,531,368 A * 7/1985 Killen ..... 60/453
5,326,386 A * 7/1994 Lee et al. ..... 96/6
5,587,068 A * 12/1996 Aho et al. ..... 210/188
6,164,927 A * 12/2000 Wehage ..... 417/307
6,364,630 B1 4/2002 Craft et al. ..... 417/310
6,390,783 B1 5/2002 Wong et al. ..... 417/53
6,422,845 B1 7/2002 Wong et al. ..... 418/133
6,478,549 B1 11/2002 Aden et al. ..... 417/300
6,481,990 B2 11/2002 Wong et al. ..... 418/82
6,481,992 B2 11/2002 Wong et al. ..... 418/132
6,497,557 B2 12/2002 Aden et al. ..... 417/87

* cited by examiner

*Primary Examiner*—Justine Yu
*Assistant Examiner*—Han L Liu
(74) *Attorney, Agent, or Firm*—Michael D. Smith

(57) ABSTRACT

A hydraulic fluid reservoir for a hydraulic power system includes a reservoir housing having an internal chamber for containing a supply of hydraulic fluid, an outlet for communicating the fluid from the housing to an inlet of a hydraulic pump, and a return flow inlet for receiving a return flow of fluid into the chamber. The reservoir includes a flow diffuser having a diffuser inlet communicating with the return flow inlet for receiving at least a fraction of the return flow into the diffuser. The diffuser has an inner fluid guide wall that is preferably conical which diverges in the downstream direction in order to quiet any turbulence in the flow within the diffuser and to discharge into the bulk of the fluid into the chamber to be deaerated.

7 Claims, 5 Drawing Sheets

HYDRAULIC PUMP RESERVOIR HAVING DEAERATION DIFFUSER

BACKGROUND OF THE INVENTION

1. Technical Field

This invention relates generally to hydraulic reservoirs used for supplying hydraulic fluid to hydraulic pumps, and more particularly to the means of handling the fluid returned to the hydraulic reservoir used to feed the pump under high flow, high pressure conditions.

2. Background of the Invention

Fixed and/or variable positive deplacement hydraulic pumps have numerous applications in many fields, including automotive, aerospace, industrial, agricultural, heavy equipment and the like for performing work. In a typical hydraulic system, return fluid is simply returned into the pump reservoir where it dwells for time period before being drawn in by the inlet to the pump for recirculation. Under conditions of high load and high flow rate, such hydraulic systems are characteristically unable to keep up with the fluid demand of the pump, leading to cavitation and unacceptable levels of noise. Another inherent disadvantage with such systems is that the kinetic energy of the incoming fluid to the reservoir is lost and not utilized to feed the inlet to the pump, leading to relatively low efficiencies. Such simple single return hydraulic fluid return systems thus have their limits.

U.S. Pat. No. 5,802,804 discloses a hydraulic steering system for a motor vehicle having two separate fluid return lines leading to the reservoir. One line is a high return flow which is fed to a nozzle within the reservoir. The outlet of the nozzle is supported adjacent the inlet to the steering pump. The momentum of the return fluid exiting the nozzle creates a venturi reaction at the reservoir outlet, which has the effect of aspirating additional volumes of fluid from the reservoir into the flow. The momentum of the return fluid together with the addition of the entrained fluid from the reservoir produces a desirable "boost" effect which provides ample feed to the pump under condition of high flow and high pressure to prevent cavitation attributed to lack of sufficient inflow to the pump. The second return line delivers a fraction of the return fluid to the reservoir. Such fluid is permitted to dwell for a time in the reservoir chamber, during which time any undesolved air or gas bubbles contained in the secondary stream are liberated before the fluid is drawn in by the primary jet stream. Without the second return line, the fluid would not be sufficiently deaerated and cavitation and noise would result.

U.S. Pat. No. 6,390,783, which is commonly owned by the assignee of the present invention, discloses a hydraulic system having a single fluid return line leading into the reservoir rather than the two separate fluid return lines of prior systems. This single fluid return line extends into a chamber of the reservoir and has a nozzle at its end adjacent the outlet of the reservoir which serves to direct a high velocity jet flow of hydraulic fluid from the nozzle through the outlet, causing a "boost" of additional hydraulic fluid to be drawn into the stream from the chamber to supply the pump with ample volume and pressure of fluid. A bleed hole is formed in the nozzle which allows for a controlled flow of the incoming fluid to escape or lead directly into the reservoir chamber through the bleed hole, where it dwells for a time before being drawn out of the reservoir by the jet flow issuing from the nozzle. As the fluid dwells, any air contained in the fluid is allowed to escape and, over time, has the effect of controlling or managing the aeration of the fluid contained in the system, such that the overall aeration levels remain below the upper limits which would cause cavitation or performance definicies of the pump. In order to promote an extended dwell time of the fluid issuing from the bleed hole, the reservoir is formed with a baffle which partitions the chamber and isolates the bleed flow for a time before mixing with the other fluid in the chamber. Such baffling, however, increases the complexity and cost of manufacturing hydraulic reservoirs in places design restrictions on the size and arrangement of the reservoir and its components.

It is an object of the present invention to further improve such hydraulic return flow reservoir systems, particularly in connection with the handling of the return flow to promote effective and efficient deaeration.

SUMMARY OF THE INVENTION

A hydraulic fluid reservoir for a hydraulic power system according to the invention includes a reservoir housing having an internal chamber for containing a supply of hydraulic fluid. The housing has an outlet for communicating fluid from the housing to an inlet of a hydraulic pump, and a return flow inlet for receiving a return flow of fluid into the chamber. According to the invention, the reservoir includes a flow diffuser having a diffuser inlet communicating with the return flow inlet of the housing for receiving at least a fraction of the return flow into the diffuser. The diffuser has an inner fluid guide wall that diverges in a downstream direction and which is operative to slow the velocity of the at least fraction of the return flow received into the diffuser through controlled expansion of the cross-sectional area of the at least fraction of the return flow as it advances along the diverging inner fluid guide wall of the diffuser. The diffuser includes a diffuser outlet communicating with the chamber for introducing the slowed velocity hydraulic fluid into the chamber.

One advantage of the invention is that the diffuser can be engineered to more precisely control the deaeration of the hydraulic fluid returning to the reservoir.

The controlled shape of the diffuser has the further advantage of dissipating turbulence of the fluid entering the diffuser as the fluid travels along the length of the diffuser such that upon existing the diffuser the flow is non-turbulent and the fluid is deaerated as it mixes with the bulk of the other fluid contained in the chamber of the reservoir.

According to a further preferred feature of the invention, the diffuser preferably has a conical form with an inside angle between walls no greater than 15°, such that the fluid entering the diffuser flows in contact with the conical wall with a constantly increasing cross-sectional area, decreasing the velocity of the flow and quieting any turbulence before the fluid exists the diffuser into the chamber. During this time, any air present in the fluid is released.

The invention has the further advantage of eliminating the design constraints associated with providing a baffle or deflector within the chamber as in prior systems. With the diffuser, there is no need for a baffle.

Another advantage of employing the diffuser according to the invention is that the diffuser is open and not subject to blockage or plugging as can be screens and other devices used to slow fluid flow.

THE DRAWINGS

Presently preferred embodiments of the invention are disclosed in the following description and in the accompanying drawings, wherein.

DETAILED DESCRIPTION

Figure 1:
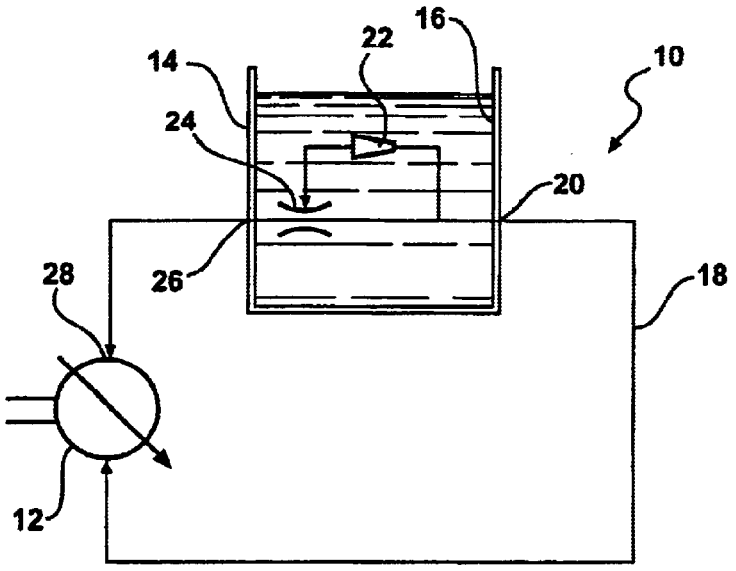
FIG. 1 is a schematic diagram of a general hydraulic system according to the invention.
Figure 2:
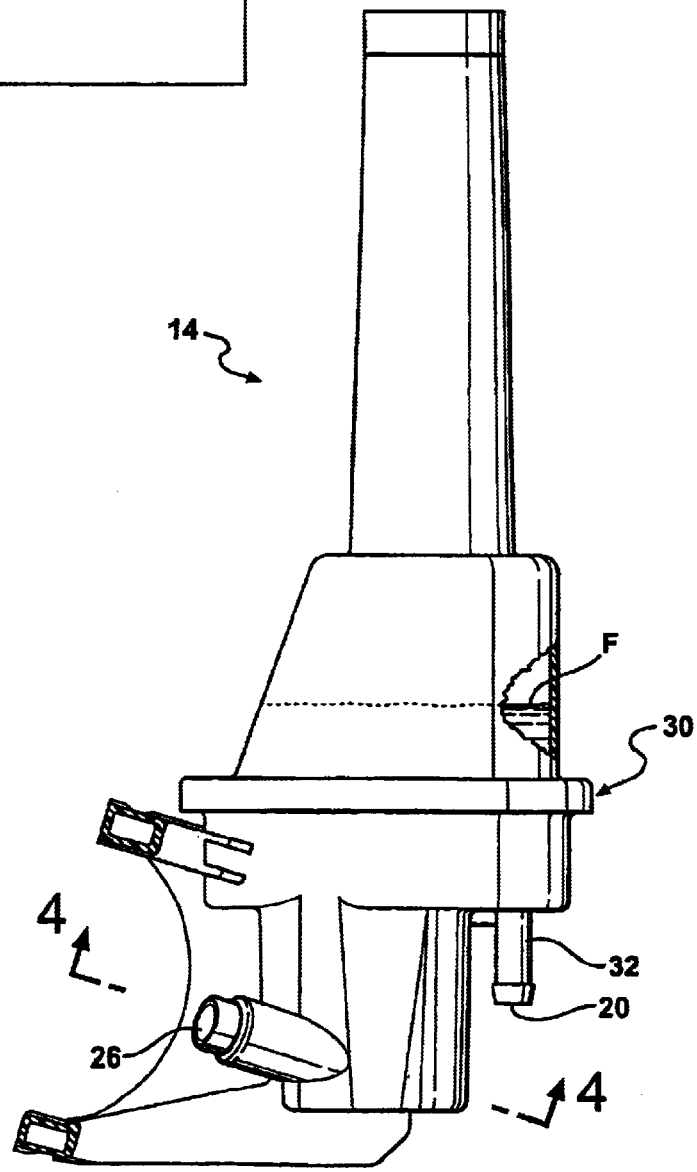
FIG. 2 is an elevation view of a hydraulic reservoir constructed according to the invention.
Figure 3:
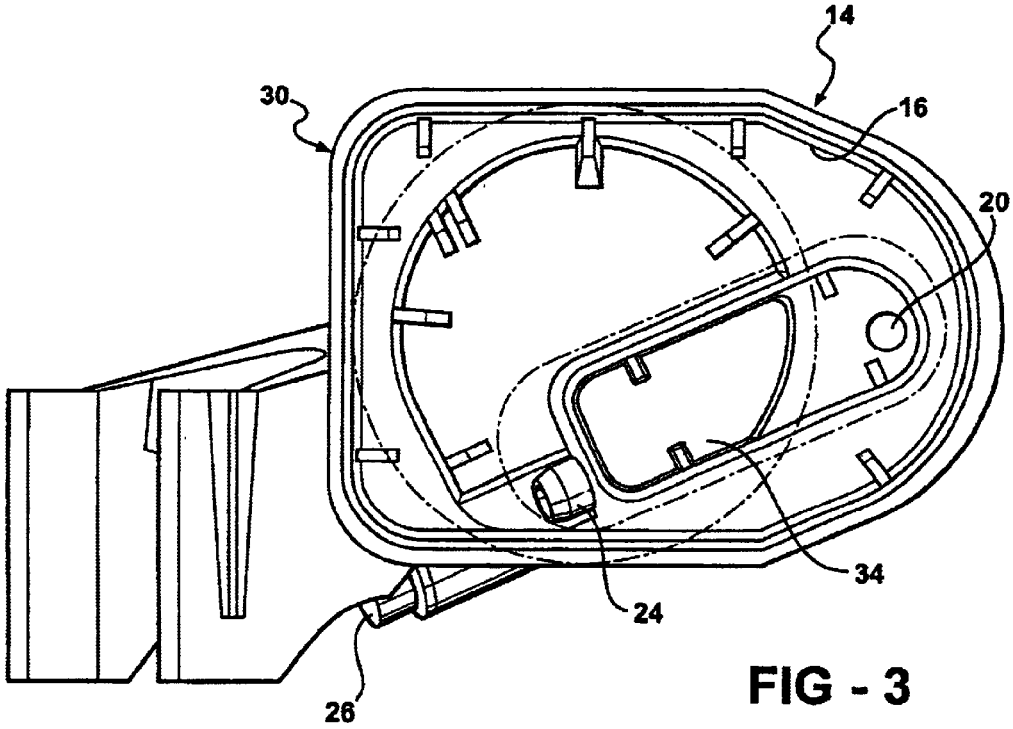
FIG. 3 is a plan view of the reservoir of FIG. 2.
Figure 4:
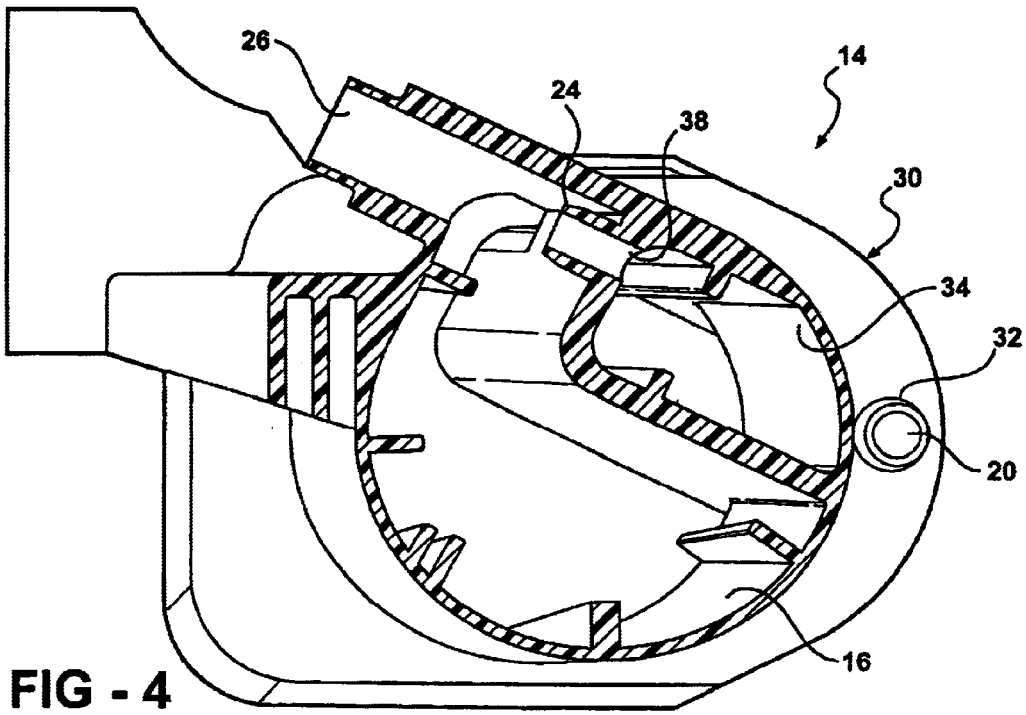
FIG. 4 is a cross-sectional plan view of the reservoir.
Figure 5:
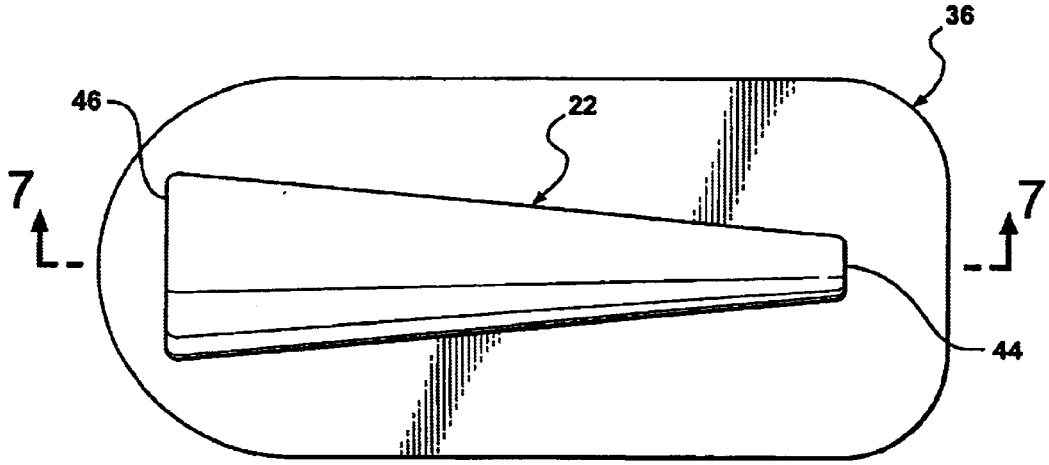
FIG. 5 is a top view of the diffuser of the reservoir.
Figure 6:
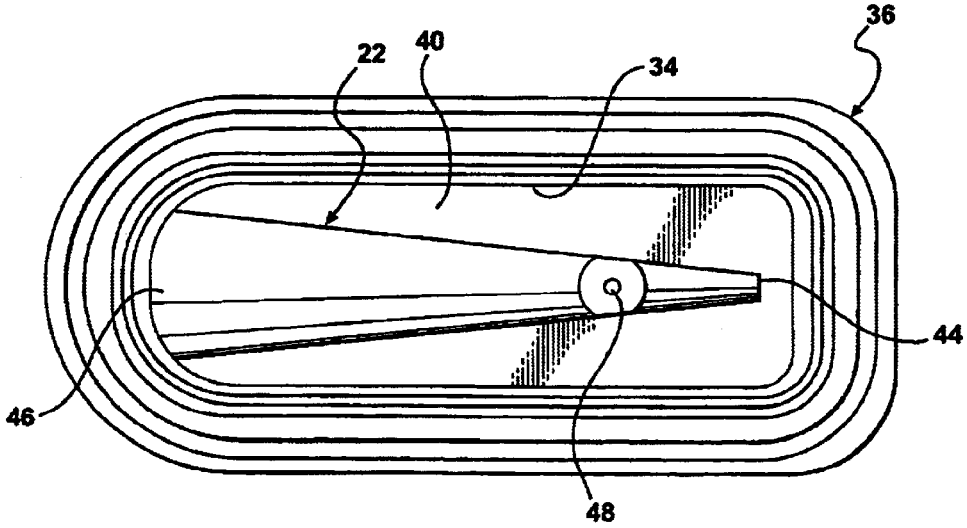
FIG. 6 is a bottom view of the diffuser.

Referring initially to FIG. 1, a schematically hydraulic system 10 is shown having a pump 12 and a reservoir 14 having a chamber 16 containing a supply of hydraulic fluid used to operate the pump 12. In this system 10, hydraulic fluid returned from the pump 12 is fed through a single return line 18 communicating with a return flow inlet 20 of the reservoir 14. The pump 12 may comprise any positive fixed or variable displacement hydraulic pump including motor vehicle steering pumps, oil pump, transmission pumps, as well as hydraulic pumps used in industrial, agricultural, heavy-duty, rail and aerospace applications and other similar or equivalent applications.

According to the invention, at least a fraction of the return flow of hydraulic fluid delivered to the return flow inlet 20 of the reservoir 14 is passed through a diffuser 22 which operates to slow the flow and quiet any turbulence such that the fluid exiting the diffuser 22 is non-turbulent and deaerated, as will be explained in further detail below with regard to the construction and operation of the diffuser 22. It is further preferred, but not necessary, that a substantial fraction of the return fluid be passed through a flow-restricting booster nozzle 24 which acts to increase the velocity of the fluid exiting the nozzle 24 at an outlet 26 of the reservoir, causing hydraulic fluid F in the vicinity of the outlet 26 to be drawn of aspirated into the accelerated flow, so as to deliver a boosted, high velocity flow of hydraulic fluid out through the outlet 26 of the reservoir 14 and into an inlet 28 of the pump 12 to operate the pump.

It will be appreciated that the schematic of FIG. 1 is a greatly simplified hydraulic flow system 10 provided for illustrating the basic principles of operation. In practice, the reservoir 14 can be used in conjunction with various hydraulic flow systems associated with various pumps such as those mentioned above and including, for example, the flow systems illustrated and described in U.S. Pat. Nos. 5,802,848, and 6,390,783, both of which are assigned to the assignee of the present invention and their disclosures incorporated herein by reference, including the teaching of the arrangement and operation of more detailed hydraulic flow systems and of the construction and operation of an exemplary hydraulic pump 12.

Turning now in greater detail to FIGS. 2–8, the hydraulic fluid reservoir 14 includes a reservoir housing 30 having the chamber 16 therein and preferably fabricated of molded plastics material. The return flow inlet 20 is defined in part by a tubular inlet stem 32 which attaches to one end of the return line 18 for directing hydraulic fluid into the housing 30. With reference to the first embodiment of FIGS. 2–8, the incoming fluid coming from the single return line 18 is under elevated pressure and is fed to an enclosed booster nozzle space 34 which is walled off from the chamber 16 so as to maintain a higher pressure of fluid within the space 34 than that of the adjacent chamber 16. The booster nozzle space 34 is preferably formed with a constricted passage 38 adjacent the outlet 26 of the reservoir 14 which serves as the booster nozzle 24. As the pressurized fluid encounters the booster nozzle 24, it is forced through the constricted passage 38 which creates an increased back pressure in the booster nozzle space 34 and a corresponding sudden drop of pressure at the location where the fluid exits the constricted passage 38 which, as described above, has the effect of increasing the velocity of the discharged fluid introduced to the pump inlet 28 and drawing an additional flow of fluid from the chamber 16 into the high velocity stream to provide a "boosted" supply of high velocity hydraulic oil to the pump 12 for its operation.

Figure 7:
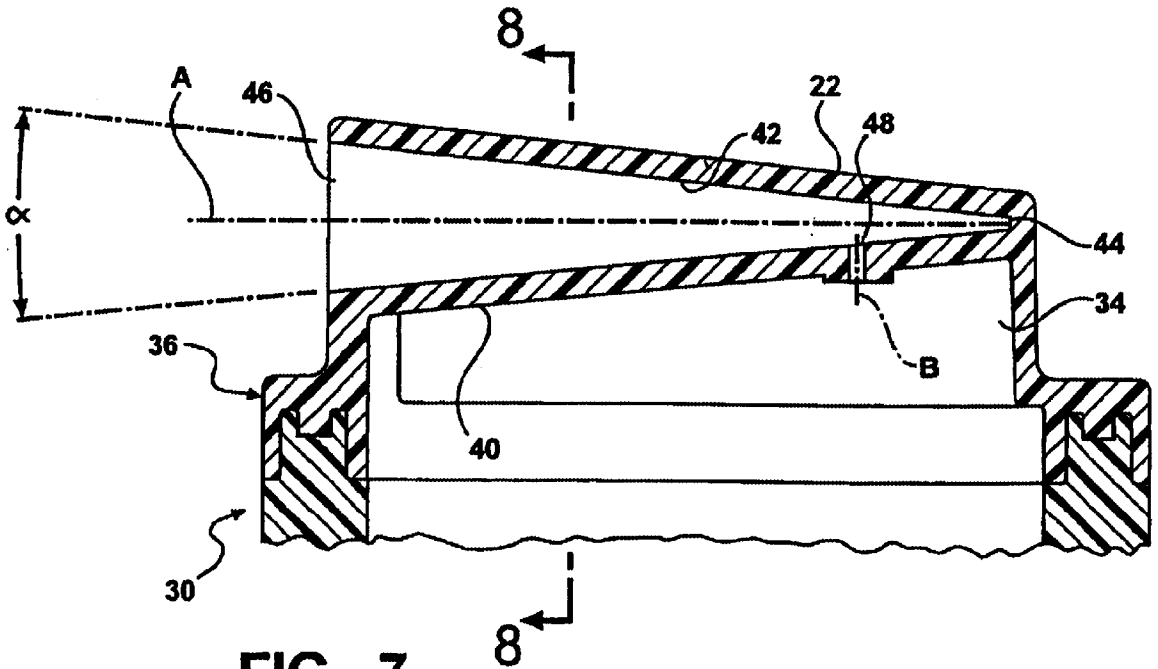
FIG. 7 is a longitudinal cross-sectional view of the diffuser of FIG. 4.
Figure 8:
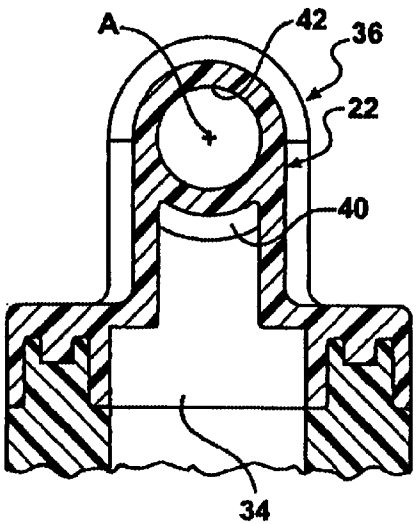
FIG. 8 is a transverse sectional view of the diffuser.

A partition plate 36 is preferably formed with the diffuser 22 which is immediately adjacent the booster nozzle space 34, but separated therefrom by a partition wall 40 (FIG. 7). The diffuser 22 has an inner fluid guide wall 42 which is preferably conical in shape and disposed symmetrically about a central flow axis A and diverging along the axis A between an upstream end 44 and a downstream end 46. The inner fluid guide wall 42 is formed with a diffuser inlet opening 48 which communicates with the return flow inlet 20 of the reservoir 14. In the present embodiment, the diffuser inlet 48 defines a small opening between the diffuser 22 and the high pressure booster nozzle space 34. The back pressure developed in the booster nozzle space 34 as a result of the constricted passage 38 of the booster nozzle space 34 causes a continuous fraction of flow of the returned fluid introduced to the booster nozzle space 34 to leak or bleed from the booster nozzle space 34 into the space of the diffuser 22 through the diffuser inlet or bleed hole 48. The diffuser inlet 48 is disposed along a diffuser inlet axis B which is transverse to the central flow axis A of the diffuser 22, such that the flow of fluid entering the diffuser 22 enters at an angle relative to the axis A of the diffuser. The diffuser inlet 48 is preferably spaced from the upstream end 44 of the diffuser 22, although the inlet 48 is considerably closer to the upstream end 44 than it is to the downstream end 46.

As mentioned, the inner fluid guide wall 42 of the diffuser 22 is preferably conical in shape, and has an inside cone angle $\alpha$ preferably less than 15°, and preferably in the range of 6–15°. The shape of the diffuser causes the fraction of hydraulic fluid entering the diffuser 22 to contact and be slowed by the conical guide wall 42 as it travels in the axial direction of the diffuser from the upstream end 44 toward the downstream end 46. Other shapes which provide a controlled expansion of the cross-sectional area are also contemplated by the invention. As the fluid travels along the diffuser 22, the diverging conical shape of the guide wall 42 slowly and continuously increases the available cross-sectional area which the fluid can occupy. This contact with the wall 42 and controlled increased in cross-sectional area has the effect of slowing the velocity of the flow and quieting any turbulence in the flow, such that the flow exiting the downstream end 46 of the diffuser 22 is non-turbulent. The downstream end 46 of the diffuser 22 is in open flow communication with the chamber 16, such that the quiet, non-turbulent flow of fluid existing the diffuser 22 mixes with the bulk of the fluid in the chamber 16 and can then be deaerated and drawn in via the fluid passing through the booster nozzle 24 to supply a boosted flow of fluid to the pump 12 in the manner described above.

Figure 9:
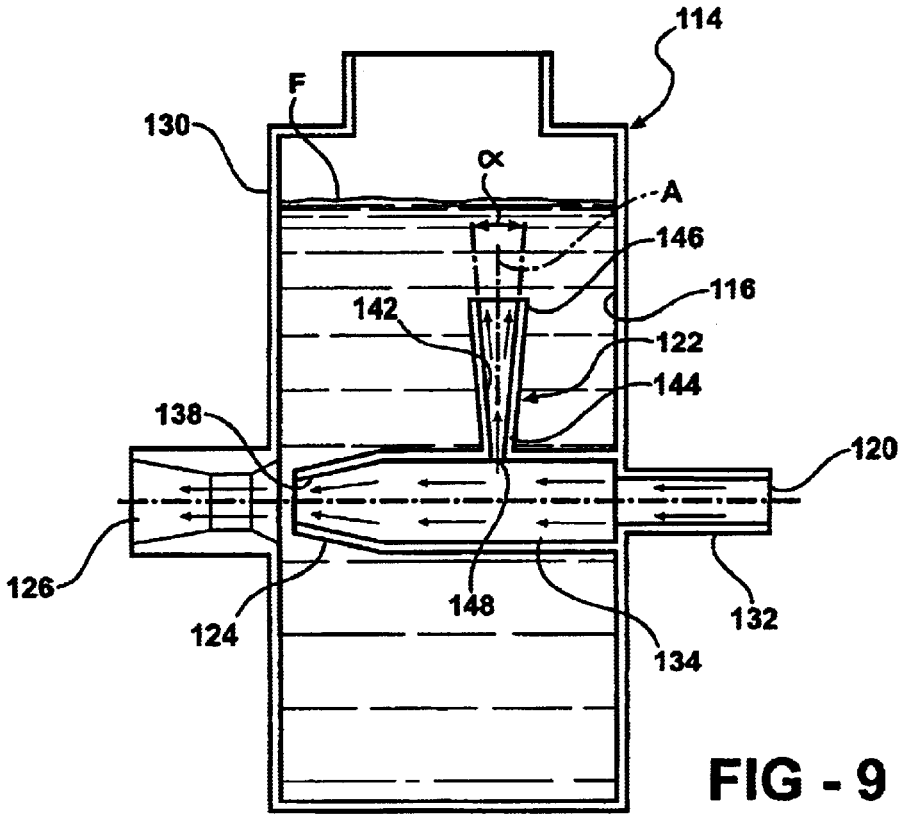
FIG. 9 is a cross-sectional view of a second embodiment of the invention.

FIG. 9 shows an alternative embodiment of the invention wherein the same reference numerals are used to designate like features, but are offset by 100. In this embodiment, the diffuser 122 and bleed hole 148 are coaxial, rather than transversely oriented, such that the diffuser inlet 48 enters the diffuser 122 at the upstream end 144 along to central axis A of the diffuser 122. The diffuser 122 otherwise operates in the same manner to slow the flow of hydraulic fluid introduced into to diffuser 122 through to bleed hole 148 to eliminate turbulence and to deaerate the fluid before its introduction into the chamber 116.

Figure 10:
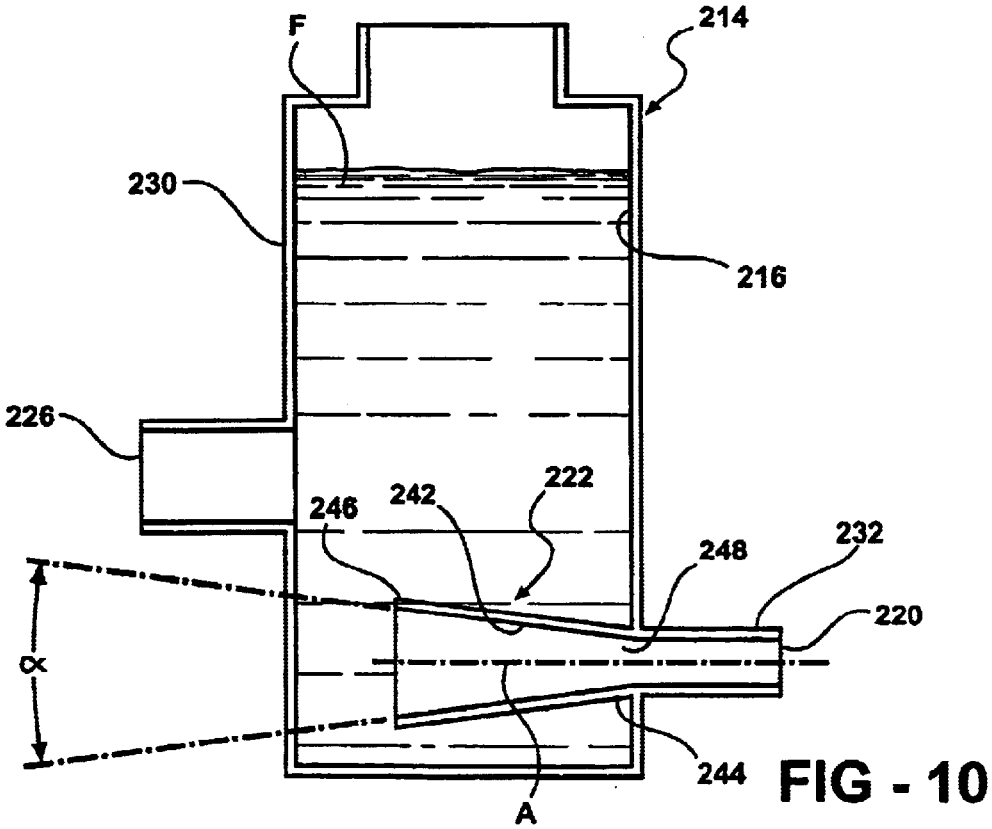
FIG. 10 is a cross-sectional view of a third embodiment of the invention.

FIG. 10 illustrates a further embodiment in which the same reference numerals are used to represent like features, but are offset by 200. In this third embodiment, the diffuser 222 communicates directly with the return flow inlet 220 and is not associated with any booster nozzle feature, which is lacking in this embodiment. This embodiment illustrates the versatility of the diffuser, showing that it can be used both with and without a hydraulic boost feature of a reservoir. The diffuser 222 otherwise operates in the same manner as that described above in connection with the diffusers of the two prior embodiments.

The disclosed embodiments are representative of presently preferred forms of the invention, but are intended to be illustrative rather than definitive thereof. The invention is defined in the claims.

What is claimed is:

1. A hydraulic fluid reservoir for a hydraulic power system, comprising:

a reservoir having an internal chamber for containing a supply of hydraulic fluid, a reservoir outlet for communicating fluid from said reservoir to an inlet of a hydraulic pump, and a return flow reservoir inlet for receiving a return flow of fluid into said chamber; and a flow diffuser having a diffuser inlet communicating with said return flow reservoir inlet for receiving at least a fraction of the return flow into said diffuser and having an inner fluid guide wall that diverges in a downstream direction and which is operative to slow the velocity of the at least a fraction of the return flow received into said diffuser through controlled expansion of a cross-sectional area of the at least a fraction of the return flow as the at least a fraction of the return flow advances along said diverging inner fluid guide wall, and a diffuser outlet communicating with said chamber for introducing the slowed at least a fraction of the return flow into said chamber where the slowed at least a fraction of the return flow can deaerate; and a booster nozzle extending into said chamber from said reservoir inlet and having a constricted primary discharge opening aligned with said reservoir with said outlet for directing an accelerated jet stream of the hydraulic fluid out of said chamber through said reservoir outlet, and also having a secondary bleed hole opening which is operative to discharge the at least a fraction of the return flow from said booster nozzle into said chamber, and wherein said flow diffuser is disposed at said bleed hole.

2. The reservoir of claim 1 wherein said inner fluid guide wall is substantially conical in shape.

3. The reservoir of claim 2 wherein said inner fluid guide wall has an inside angle greater than zero degrees and less than about 15 degrees.

4. The reservoir of claim 1 wherein said flow diffuser is disposed in said chamber.

5. The reservoir of claim 1 wherein said diffuser has a central flow axis and said diffuser inlet is disposed along a diffuser inlet axis which is transverse to said central flow axis.

6. The reservoir of claim 5 wherein said diffuser has an upstream end and a downstream end spaced from said upstream end along said central flow axis, and said diffuser inlet is spaced axially from said upstream end.

7. The reservoir of claim 6 wherein said diffuser inlet is disposed closer to said upstream end than to said downstream end.

* * * * *